US005553846A

United States Patent [19]

Frye et al.

[11] Patent Number: 5,553,846

[45] Date of Patent: Sep. 10, 1996

[54] SYSTEM FOR TRAINING A PITCHER TO PITCH A BASEBALL

[76] Inventors: William H. Frye, 7461 San Blanco, Goleta, Calif. 93117; Randall J. Peck, 3575 Durham Cir., Oceanside, Calif. 92056

[21] Appl. No.: 11,641

[22] Filed: Jan. 28, 1993

[51] Int. Cl.[6] ..... A63B 69/40

[52] U.S. Cl. ..... 273/26C

[58] Field of Search ..... 273/26 C, 359

[56] References Cited

U.S. PATENT DOCUMENTS 5,199,705 4/1993 Jenkins ..... 273/26 C

*Primary Examiner*—Theatrice Brown

*Attorney, Agent, or Firm*—W. Edward Johansen

[57] ABSTRACT

A system for training a pitcher to pitch a baseball includes a plurality of emitting body markers worn by the pitchers, a plurality of position detectors for measuring both the position of the emitting body markers and the position of the pitched baseball, a target, a processor and a display. The processor is coupled to the emitting body markers, the position detectors and the target. The pitcher pitches the baseball to the target. The display is coupled to the processor. Each position detector is a locating array which has at least one ultrasonic transmitter and at least three non-collinear ultrasonic receivers. The locating array is disposed in the path of flight of the pitched baseball and and is used to determine the speed and the trajectory of the pitched baseball. The position of the emitting body markers are measured either optically or ultrasonically over a period of time so as to enable the analysis of the pitcher's body mechanics. The body mechanics analysis is also applicable to the golf, tennis, other sports and medical diagnostics.

6 Claims, 5 Drawing Sheets

SYSTEM FOR TRAINING A PITCHER TO PITCH A BASEBALL

BACKGROUND OF THE INVENTION

The field of the invention is systems for analyzing athletic performance and body mechanics of a subject, for example, those body mechanics of a pitcher who is being trained to pitch a baseball.

U.S. Pat. No. 4,830,369 teaches a baseball pitching practice target which includes a plurality of panel members disposed side-by-side to form a target area and a support frame which independently supports the panel members. Each panel has a designated segment portion of the target area. The target area includes a central strike zone area which is delimited by some of the panel members. A plurality of normally-open electrical contact are associated with each panel and are closable upon the application of an impact force on an outer surface of its associated panel. A display device identifies which panel has been subjected to an impact force. A visual display identifies the panel having been impacted and also provides a numerical read-out of a total numerical value with each of the panels having independent numerical values.

U.S. Pat. No. 4,629,188 teaches a baseball target device which includes a target that is adjustable in height and length to simulate the strike zones of different size batters. The baseball target device utilizes a base to which a telescopically adjustable vertical frame is attached, wherein the frame supports an adjustable spring-loaded window shade device. The shade of this device hangs down from the frame and its unrolled portion defines a "strike zone" for the pitcher. A picture of a crouched catcher and umpire is imprinted on the shade to give the target a realistic effect. The pitcher may adjust the target to the size of the strike zone for a particular batter by adjusting the telescopic frame to the height of the batter's shoulder and then adjusting the target shade to the batter's knee, thus creating a target whose size and location simulates the exact strike zone for that particular batter.

U.S. Pat. No. 5,064,194 teaches an apparatus for practicing pitching of baseballs to enable a user to improve pitching accuracy and to indicate pitched balls delivered within a strike zone.

U.S. Pat. No. 4,955,607 teaches a double loop device for practicing spot pitching which simulates actual game conditions.

U.S. Pat. No. 4,781,376 teaches a life-like training device for pitchers which has a target including a catcher figure and separate batter figure. Both the catcher figure and batter figure are adjustable in height to simulate different sized batters from Little League to adult size. The batter figure can be supported as a left or right handed batter and is pivotable as well as adjustable in distance from the catcher to simulate different batter box positions. A catcher's mitt target is supported on the catcher figure in different positions for different pitches and has an alarm in the pocket of the mitt to indicate an on-target pitch.

U.S. Pat. No. 4,563,005 teaches an apparatus for detecting and computing the location of a baseball as it is pitched over a plate in which infrared receivers are disposed at corner locations on opposite sides of a target zone which is aligned with the plate. First and second arrays of infrared emitters are mounted on opposite sides of the target zone for transmitting infrared light pulses to the opposite corner receivers. The infrared emitters are sequentially energized and transmit infrared pulse signals having relatively short durations in a scan cycle. Digital data words representative of the reception and nonreception by the receivers of the optical pulse signals are generated during each pulse interval of the scan cycle. Computer circuitry calculates the coordinates of the baseball within the target zone as a function of predetermined angular data retrieved computer memory. The computer memory is preprogrammed with a table of angular data corresponding to each receiver data word and the particular emitter pulse interval in which it occurs.

U.S. Pat. No. 4,545,576 teaches a baseball-strike indicator and trajectory analyzer which computes the trajectory of a moving object by remote, non-interfering sensors. The apparatus is able to compute the trajectory of a pitched baseball throughout its flight, including the trajectory of the baseball as it passes in the vicinity of a three-dimensional strike zone. The apparatus includes two pairs of video cameras, an alignment mechanism, video-storage device, a digitizer, a computer, output devices and an operator's console. The baseball-strike indicator and trajectory analyzer is required to identify the baseball, compute its position in three dimensions as a function of time, compute the speed of the baseball and its trajectory, and present the output via computer graphics to present the viewer with essentially any desired view of the pitched baseball.

U.S. Pat. No. 4,657,250 teaches a pitching practice apparatus which includes a frontal mechanical strike zone target at which the pitcher aims the ball and which contains yielding elements enabling the ball to pass rearwardly through a photoelectric sensing plane having sensing beams on two orthogonal axes. The photoelectric sensing arrangement precisely locates the position of the ball in the strike zone horizontally and vertically.

U.S. Pat. No. 5,138,322 teaches an apparatus for continuously and precisely measuring the positions of a tennis ball in motion in a predefined three-dimensional region. The apparatus transmit multiple radar signals from a first, second and third antenna devices into the predefined three-dimensional region. Multiple return signals are sensed and are compared with the transmitted signals to determine phases of the return signal to thereby obtain ranges of the object.

U.S. Pat. No. 4,858,922 teaches an apparatus for determining the velocity and path of travel of a ball which includes a pair of velocity sensing devices which are are disposed on opposite sides of the proposed path of travel of a ball. The electromagnetic energy beams from the sensing devices are directed at acute angles to the proposed path of travel. Velocity signals which are generated by the two sensing devices are averaged and converted to visible messages concerning the speed of the ball and its likely distance of travel had its flight not been interrupted.

U.S. Pat. No. 4,673,183 teaches a golf playing arrangement which includes a fairway, a tee area at one end of the fairway, a plurality of radar ground surveillance units located on the fairway at a successively greater distance from the tee area, a central processor, a video display and a putting green adjacent the tee area. Each ground surveillance unit detects golf balls moving on the ground in a predetermined circular area. The central processor calculates and the computer terminal visually displays the distance of the unit furthest from the tee area which detects a golf ball moving therethrough, and the sum of a succession of such distances.

U.S. Pat. No. 4,979,745 teaches an apparatus for practicing a golf swing includes a processor, a transmitter-receiver and a relay. The transmitter-receiver is stationarily arranged on the ground. The relay is attached to the golf club in or near to the head thereof. The transmitter-receiver includes an infrared light emitter and a pair of receivers. The relay includes a receiver for receiving the light from the emitter of the transmitter-receiver and a infrared ray emitter for emitting a ray toward the pair of receivers of the transmitter-receiver. The processor processes the light received by the pair of receivers separately, for detecting a change in intensity at time elapses for calculating the direction of the swing, and the timing of a maximum intensity for obtaining the head speed.

U.S. Pat. No. 4,898,389 teaches a golf training device which detachably coupled to the head of any golf club in order to give a golfer an exact indication of the point of impact of the face of a golf club with a golf ball. The training device includes a housing which supports at least one impact sensitive transducer, an electronic circuit and a display system. The impact sensitive transducer generates an electric signal upon impact. The electronic circuit determines if the transducer has received an impact. The display system is responsive to the electronic circuit and signals if the transducer has received an impact. There is a mechanism for connecting and disconnecting the training device to a golf club head. When attached to the head of a club, with the transducer on the face of the club, and swung into contact with a golf ball, the transducer generates an electrical signal which is transmitted to the electronic circuit which processes the electrical signal and transmit it to the display system which indicates the point of contact of the club face with the golf ball.

U.S. Pat. No. 4,708,343 teaches a baseball practice apparatus which includes a vertically extending panel having a plurality of selectively operable lights which generate focused light beams directed forward from the panel. A player swings a bat having a light reflecting surface which will intercept and cause the light beams to be reflected back towards the panel. On the panel there is an array of spaced light sensors. One of the light sensors detects the reflected light. A visual indication is provides the simulated result of the swing, for example, a "line drive" or a "fly ball". A foregoing visual display is provided in response to which a light, or lights, were illuminated to simulate a pitched ball and which a sensor senses reflected light from the bat A "curve", a "sinker" or other pitch is simulated by actuating selected lights in a predetermined sequence.

U.S. Pat. No. 4,515,365 teaches an apparatus for measuring and analyzing the swing of a baseball player. The apparatus includes devices for emitting a plurality of spaced light beams projected in directions to be intersected by the swing plane of a bat and a corresponding plurality of light receiving elements arranged to receive light beams reflected from the bat. Signals received by the light receiving elements are collected and supplied to a processing apparatus and the results of this processing are displayed on a display which provides indication of angle, speed and level of the swing. The information may also be provided to a printer. The apparatus indicates whether the swing is performed normally and if it deviates from normal indicates the error involved.

U.S. Pat. No. 4,977,896 teaches an array of magnetic and/or electrical sensors external which measures signals produced by brain activity. Each sensor of the array of magnetic and/or electrical sensors is external to but proximate to either the head or other portion of the body of a subject. The measurements which are obtained simultaneously from all of the sensors are combined in a manner to permit selective measurement of the electrical activity from a specified location within the body, or alternatively, to permit the location in the body producing a particular type of response to be identified. The instantaneous measurement of each sensor is scaled by a weighting coefficient for that sensor, and the products added over all of the sensors. The weighting coefficients are calculated from a mathematical model of the brain that includes information on the shape of the potential source, the extent or type of source activity, the electrical and magnetic properties of the media, and the locations and orientations of the sources and the sensors.

SUMMARY OF INVENTION

The present invention is directed to a system for training a pitcher to pitch a baseball. The system includes a plurality of position detectors, a processor, a display and a target to which the pitcher pitches the baseball.

In a first aspect of the invention each position detector is disposed in the path of flight of the pitched baseball.

In a second aspect of the invention each position detector is a locating array which has at least one ultrasonic transmitter and at least three ultrasonic receivers.

In a third aspect of the invention each position detector includes an ultrasonic transmitter and an ultrasonic receiver coupled to either a catcher or a coach for computing the speed of a pitched baseball.

In a fourth aspect of the invention a smart plate includes a plate, at least one optical transmitter and at least one optical receiver both of which are disposed inside the peripheral edge of the plate for detecting the time dependent position in a two-dimensional space of the pitched baseball as it overpasses the first smart plate.

In a fifth aspect of the invention the smart plate also includes at least one ultrasonic transmitter and at least one ultrasonic receiver coupled to the top surface of the plate for detecting the time dependent height of the pitched baseball as it overpasses the first smart plate.

In a sixth aspect of the invention a second smart plate has a plate, at least one ultrasonic transmitter and at least three ultrasonic receivers all of which are coupled to the top surface of the plate for detecting the time dependent position in a three-dimensional space of a pitched baseball as it overpasses the second smart plate.

In a seventh aspect of the invention a plurality of locating arrays are disposed around a pitcher who is wearing a plurality of ultrasonic transmitters for analyzing his pitching mechanics.

In an eighth aspect of the invention a catcher's mitt is a movable target to which a pitcher pitches a baseball and a movement detector coupled to the catcher's mitt so that the movement detector measures the distance which a catcher moves his mitt from its initial target position to the position required for catching the pitched baseball.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE INVENTION

FIG. 1 is a schematic diagram of a pitcher, a catcher who is wearing a wrist speedgun and automatic target unit, a system for training the pitcher to pitch a baseball including a plurality of locating arrays disposed both along the path of flight of the baseball and around the pitcher, a smart plate, a processor which is coupled to the locating arrays and a display according to the first embodiment.

DESCRIPTION OF THE PREFERRED EMBODIMENT

Figures 1, 2, 6, 7, 8:
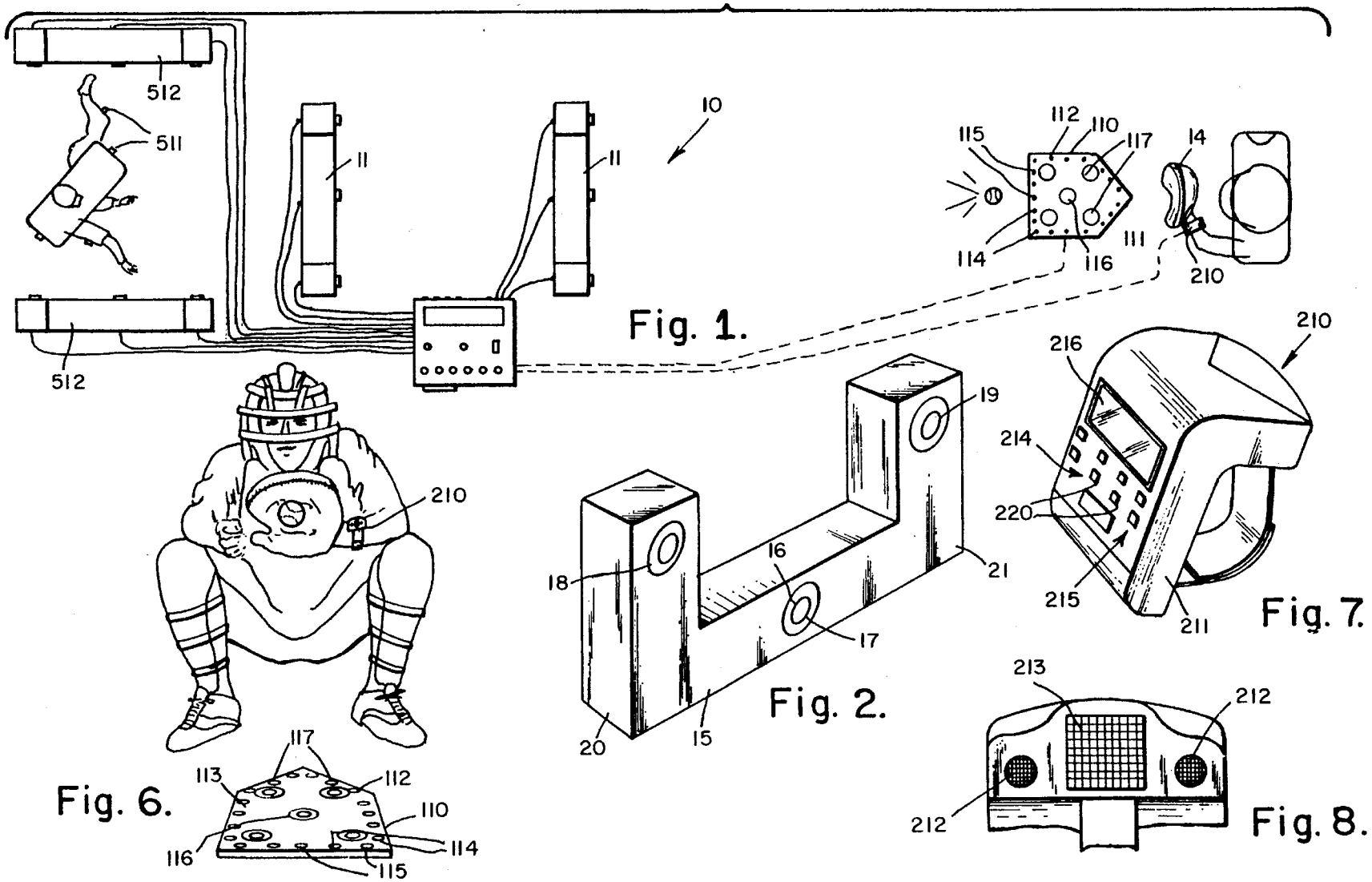
FIG. 2 is a perspective drawing of one of the locating arrays of FIG. 1 which includes one ultrasonic transmitter and three ultrasonic receivers.
FIG. 6 is a schematic diagram of the smart plate and the catcher wearing the wrist speedgun and automatic target unit of FIG. 1.
FIG. 7 is a perspective of the wrist speedgun and automatic target unit of FIG. 1.
FIG. 8 is a partial front elevational view of the wrist speedgun and automatic target unit of FIG. 1.

Referring to FIG. 1 in conjunction with FIG. 2 a system 10 for training a pitcher to pitch a baseball includes a plurality of ball position detectors 11, a processor 12 and a display 13 and a target 14 to which the pitcher pitches the baseball. Measuring the time dependent three-dimensional trajectory of the pitched baseball in flight inherently provides three-dimensional velocity information. Accuracy is also determined from ball trajectory for the case where accuracy is measured with respect to a fixed target such as either a baseball plate or a static target such as a backstop with a visible target pattern. The processor 12 may also control and measure accuracy with respect to an electromechanical target such as an array of lights, a moving picture, or a series of impact-actuated panels. The processor 12 has the ability to modify the target which is presented to the pitcher and measure pitching accuracy autonomously within a training session.

Each ball position detector 11 is disposed in the flight path of a pitched baseball. The processor 12 is coupled to the ball position detectors 11. The display 13 is coupled to the processor 12. The target 14 is coupled to the processor 12. The target 14, the ball position detectors 11 and the processor 12 operate together to determine the speed, the accuracy and the trajectory of the pitched baseball. Each ball position detector 11 is a locating array which includes an elongated housing 15, an ultrasonic transmitter 16 and three non-collinear ultrasonic receivers 17, 18 and 19. The transmitter 16 and the three ultrasonic receivers 17, 18 and 19 operate together to determine the three-dimensional position of the pitched baseball as it flies within the field of view of the ball position detector 11. Each ball position detector 11 is usually placed on the ground between the pitcher and the target and is oriented at right angles to a straight line drawn from the pitcher to the catcher. A plurality of ball position detectors 11 are used under control of the processor 12 to track the pitched baseball over its flight path.

The processor 12 initiates the transmission of a signal from the ultrasonic transmitter 16. The signal is reflected from the baseball and returns to the ultrasonic receivers 17, 18 and 19. Based on the delay time between the time of transmission and the time at which the echoes are received by ultrasonic receivers 17, 18 and 19 the position of the pitched baseball at the time of reflection is determined. The plurality of ball position detectors 11 each of which is under the control of the processor 12 produces a series of multiple transmit and receive cycles which the processor 12 uses to determine the three-dimensional position of the pitched baseball in flight.

In the preferred embodiment each ball position detector 11 includes an elongated housing 15, an ultrasonic transmitter 16, a first ultrasonic receiver 17, a second ultrasonic receiver 18 and a third ultrasonic receiver 19. The elongated housing 15 has a first end 20 and a second end 21. The ultrasonic transmitter 16 is coupled to the elongated housing 15 between the first and second ends 20 and 21 thereof and is disposed at a first vertical level. The first ultrasonic receiver 17 is coupled to the elongated housing 15 between the first and second ends 20 and 21 and is disposed at the first vertical level. The second ultrasonic receiver 18 is coupled to the elongated housing 15 at the first end 20 thereof. The third ultrasonic receiver 19 is coupled to the elongated housing 15 at the second end 21 thereof. The second and third ultrasonic receivers 18 and 19 are disposed at a second vertical level which is different than the first vertical level so that the first, second and third ultrasonic receivers 17, 18 and 19 are non-collinear thereby forming a locating array. The non-collinear arrangement is necessary to provide unique ball position calculations to be made from the three echo distances. A locating array's field of coverage (the three dimensional space in which the locating array can measure the position of the baseball) can be optimally maximized using either or both of the following techniques: a) by using additional (more than three) ultrasonic transducer elements, and b) by optimizing the angular coverage and sensitivity of each ultrasonic transducer element within the locating array. This is accomplished by forming each tranducer element out of a pluality of sub-elements which are geometicalluy and electrically coordinated.

Figure 3:
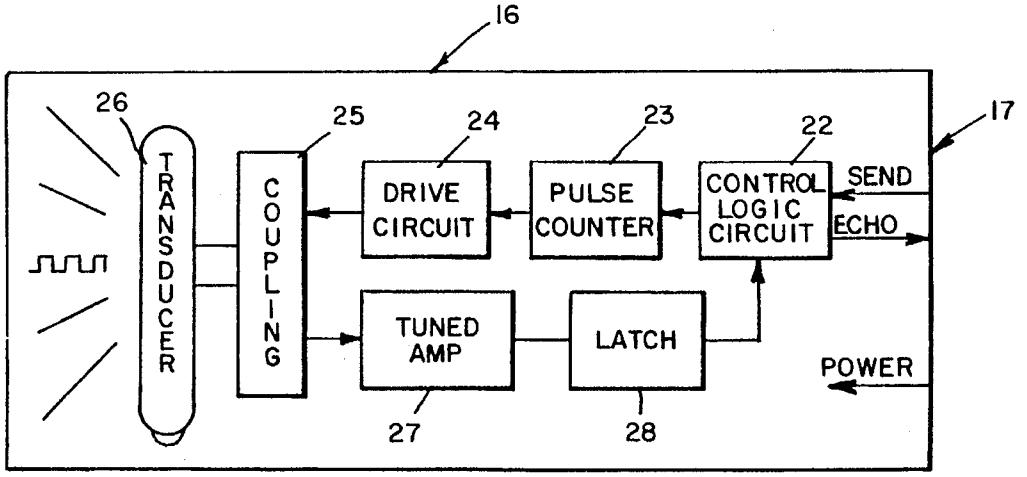
FIG. 3 is a block diagram of the locating array of FIG. 2.

Referring to FIG. 3 in conjunction with FIG. 2 the ultrasonic transmitter 16 and the first ultrasonic receiver 17 includes a control logic circuit 22, a pulse counter 23, a drive circuit 24, a coupling circuit 25, a transducer 26 or plurality of transducers, a tuned amplifier 27 and a latch 28. The coupling circuit 25 couples the drive circuit 24 to the transducer 26. The drive circuit 24 drives the transducer 26. The coupling circuit 25 is coupled to the latch 28 through the tuned amplifier 27. The latch 28 is coupled to the control logic circuit 22. The processor 12 provides a send signal to the ultrasonic transmitter 16. Based on this signal the control logic circuit 22 triggers the pulse counter 23. The pulse counter produces a series of pulses of appropriate frequency, duty cycle, and duration. The transducer 26 is driven with this temporal signal at the appropriate voltage and impedance which are provided by the drive circuit 24 and coupling circuit 25. After the echo return signal returns from the pitched baseball the transducer 26 receives the echo return signal and couples it to the tuned amplifier 27 through the coupling circuit 25. The tuned amplifier 27 conditions this echo return signal and based on magnitude and duration criteria produces a digital signal to the latch 28. The latch 28 responds by triggering the control logic circuit 22 which in turn responds by sending the echo return signal to the processor 12. Subsequent echo return signals are similarly processed.

Each of the second and third ultrasonic receivers 18 and 19 includes a control logic circuit 22, a coupling circuit 25, a tuned amplifier 27 and a latch 28. The coupling circuit 25 is coupled to the latch 28 through the tuned amplifier 27. The latch 28 is coupled to the control logic circuit 22. These elements operate in processing a received echo return signal in the same manner as described above.

Figure 5:
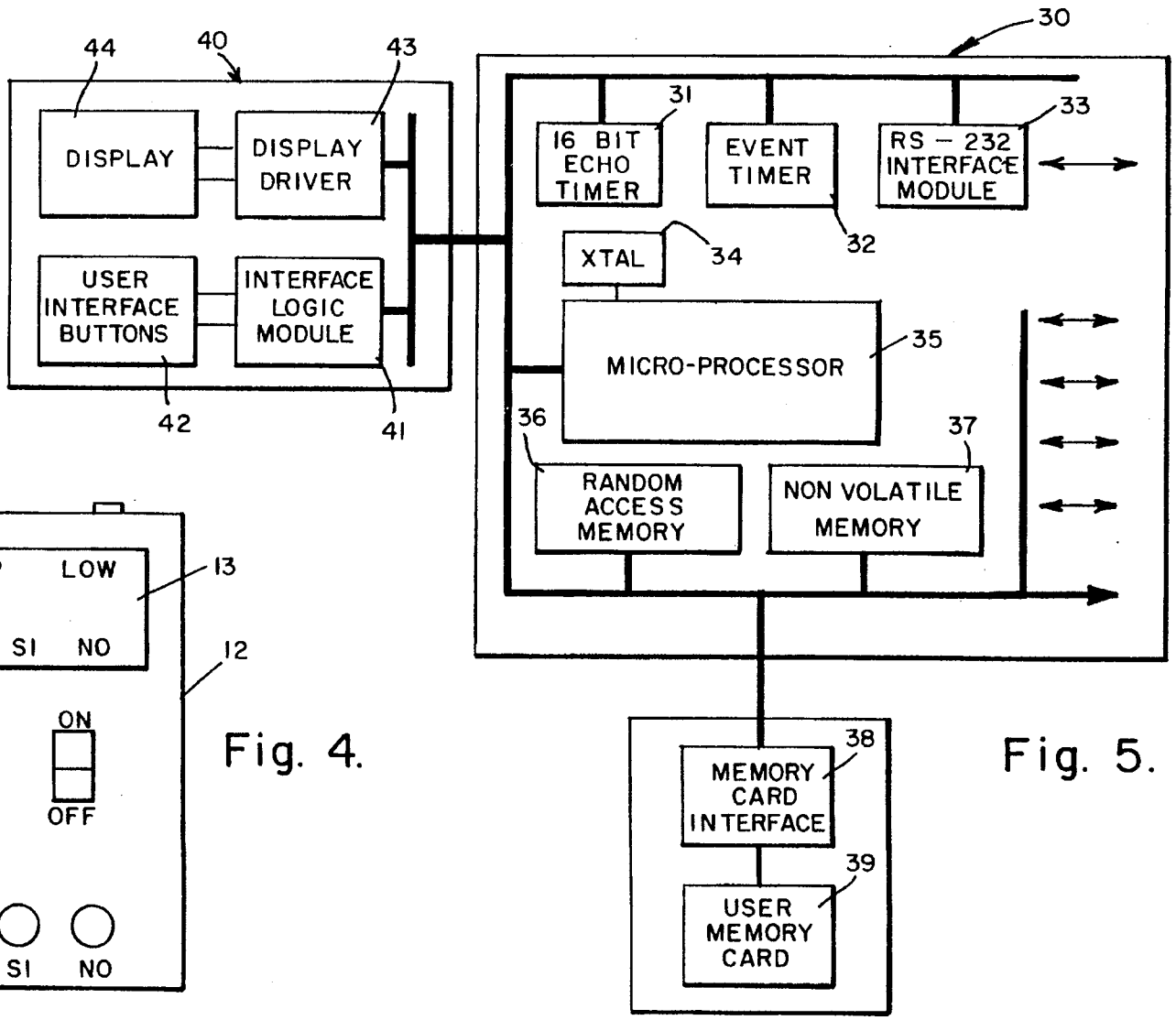
FIG. 5 is a block diagram of the processor and the display of FIG. 1 and a user interface, an acquisition and processing device and a memory module.
Figure 4:
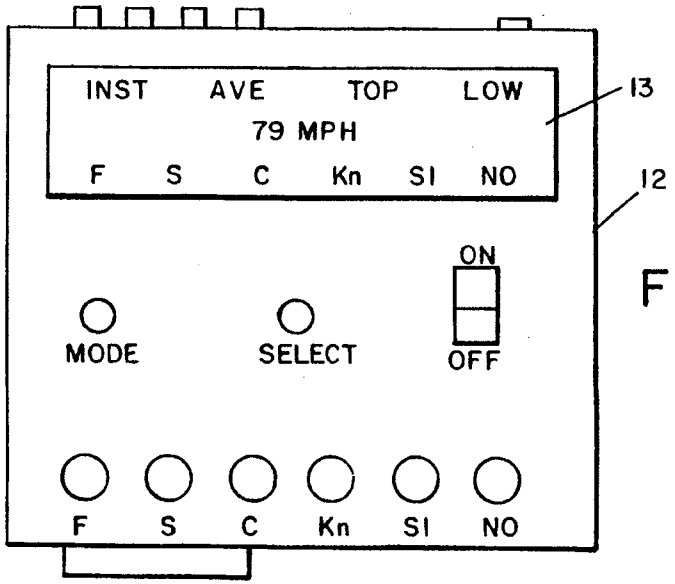
FIG. 4 is front elevational view of the processor and the display of FIG. 1.

Referring to FIG. 4 in conjunction with FIG. 1 and FIG. 5 a processor unit 30 includes sixteen bit echo timers 31 which are used to measure the duration of echoes to each receiver in the system 10, an event timer 32 which provides a master timing clock for the system 10, an RS-232 interface module 33 which allows the processor unit 30 to communicate with other computers, a crystal 34 which provides microprocessor timing, a microprocessor 35 which controls the system 10 and processes data, a random access memory 36, a non-volatile memory 37 which allows data to be held between training sessions, a memory card interface module 38 and a user memory card 39 which contains user specific data and may be retained by a specific user between training sessions. The sixteen bit echo timer 31, the event timer 32 and the RS-232 interface module 33 are coupled to the microprocessor 35. The random access memory 36 and the non-volatile memory 37 are coupled to the microprocessor 35. The user memory card interface module 38 is coupled to the microprocessor 35 and the user memory card 39. The display unit 40 includes an interface logic module 41, user interface buttons 42 on a key pad, a display driver 43 and a display 44. The display 44 displays information to the user and allows for the user to control the processor unit 30 and the entire system via the user interface buttons 42 on the key pad. The display driver 43 is coupled to the microprocessor 35. The display 44 is coupled to the display driver 43. The interface logic module 41 is coupled to the microprocessor 35. The user interface buttons 42 are coupled to the interface logic module 41.

Referring to FIG. 6 in conjunction with FIG. 1 the system 10 also includes a smart plate 110 for detecting the time dependent position in a three-dimensional flight path of the pitched baseball in order to call balls and strikes based on the location of pitched baseball as it overflies the smart plate 110. The first smart plate 110 includes a plate 111 having a peripheral edge 112 and a top surface 113, a plurality of optical transmitters 114 and a plurality of optical receivers 115. The optical transmitters 114 are disposed inside the peripheral edge 112 of the plate 111. The optical receivers 115 are disposed inside the peripheral edge 112 of the plate 111. The optical transmitters 114 and optical receivers 115 operate together with the processor 12 to detect the time dependent position in a two-dimensional space of a pitched baseball as it overpasses the smart plate 110. Each of the optical transmitters 114 projects a narrow beam of light in a vertical direction above the smart plate 110. As the pitched baseball passes over one of the peripheral edge of the smart plate 110 the beam of light is reflected from the baseball back to the smart plate 110 and is detected by the optical receivers 115. The smart plate 110 communicates this signal to the processor 12 which determines based on this signal that the pitched baseball has passed over some portion of the smart plate 110 thereby satisfying the two-dimensional criteria of a called strike. In order to measure the vertical height of the pitched baseball as it passes over the smart plate 110 the smart plate 110 also includes an ultrasonic transmitter 116 and at least one ultrasonic receiver 117. The ultrasonic transmitter 116 is coupled to the top surface 113 of the plate 111 and the processor 12. The ultrasonic receiver 117 is coupled to the top surface 113 of plate 111 and the processor 12. The ultrasonic transmitter 116 and the ultrasonic receiver(s) 117 operate together to detect the time dependent height of the pitched baseball as it overpasses the smart plate 110. The processor 12 controls the echo location process as performed by the ultrasonic transmitter 116 and the ultrasonic receiver 117. The two-dimensional information which the optical transmitters 114 and the optical receivers 115 provide and the height information which the ultrasonic transmitter 116 and the ultrasonic receiver(s) 117 provide allow for strikes to be called based on a user defined a three-dimensional strike zone. The processor 12 processes the two-dimensional information and the height information and provides the result on the display 13.

The smart plate 110 may also include an ultrasonic locating array for calling strikes and measuring the trajectory of the pitched baseball as it overflies the smart plate 110. The smart plate 110 also includes at least one ultrasonic transmitter 116 and at least three non-collinear ultrasonic receivers 117. The ultrasonic transmitter 116 and the three non-collinear ultrasonic receivers 117 are disposed inside the peripheral edge 112 of the plate 111. The ultrasonic transmitter 116 and the three non-collinear ultrasonic receivers 117 operate together to detect the time dependent position in a three-dimensional space of a pitched baseball as it overpasses the smart plate 110. The principle of operation of the smart plate 110 is same as that of the position detector 11. The ultrasonic transmitter 116 sends an ultrasound signal angled towards the incoming pitched baseball. The ultrasonic receivers 117 receive the ultrasonic echoes from the incoming pitched baseball and sends this information to the processor 12 which processes the information in order to determine the time dependent position in a three-dimensional space of the pitched baseball as it overpasses the smart plate 110. The three-dimensional information which the ultrasonic transmitters 116 and the ultrasonic receivers 117 provide allows for balls and strikes to be called based on a user defined three-dimensional strike zone. The processor 12 processes the three-dimensional information and provides the result on the display 13.

Referring to FIG. 7 in conjunction with FIG. 1, FIG. 2, FIG. 8 and FIG. 9 a wrist accuracy unit and speedgun 210 includes a housing 211, a plurality of ultrasonic transmitters 212 and an ultrasonic transmitter/receiver 213, a control panel 214, a processor 221 and a display 216. The housing 211 is coupled to a catcher's wrist adjacent to his mitt. The ultrasonic transmitters 212 and the ultrasonic transmitter/receiver 213 are coupled to the processor 221. The display 216 is coupled to the processor 221. The wrist accuracy unit and speedgun 210 not only provides a measurement of pitch accuracy in terms of the difference between the position of the catcher's mitt as the catcher present the target to the pitcher and position of the baseball when it arrives in the catcher's mitt, but provides a measurement of speed of the pitched baseball as it approaches and reaches the catcher's mitt.

Figure 9:
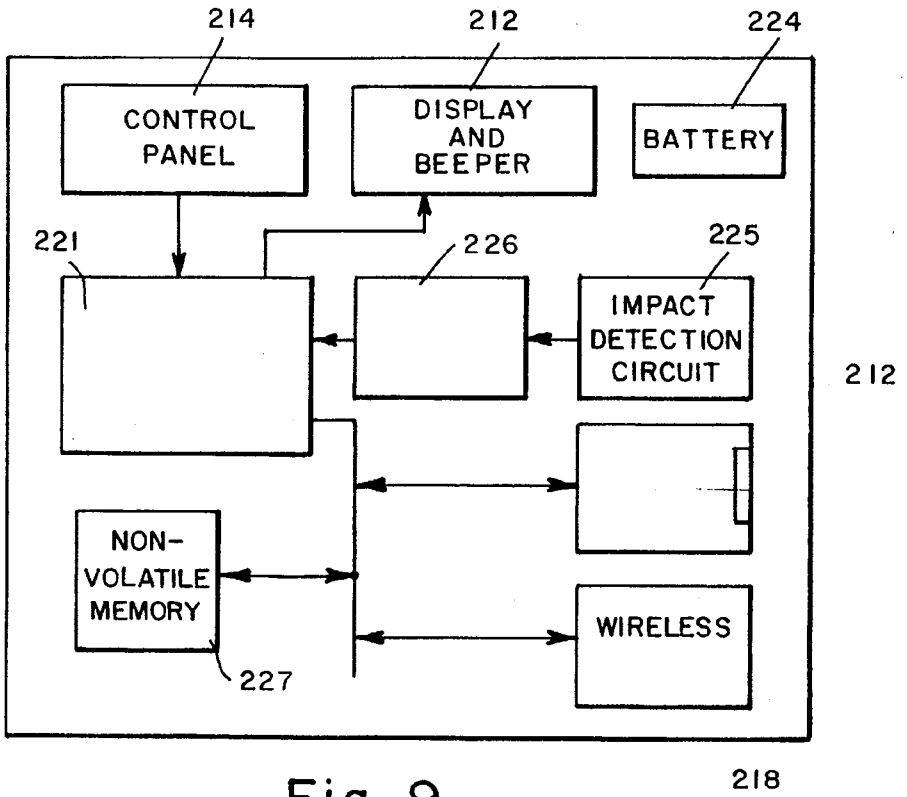
FIG. 9 is a block diagram of the wrist speedgun and automatic target unit of FIG. 1.

Referring to FIG. 9 in conjunction with FIG. 7 and FIG. 8 the wrist accuracy unit and speedgun 210 also includes a wireless transceiver 218, ultrasonic transmitters 212, an ultrasonic transmitter/reciever 213, a control panel 214, a central processor 221 with random access memory 222, a beeper 223 which is coupled to the display 216, a battery 224, a ball impact detection circuit 225, a ball impact detection conditioning circuit 226 and non-volatile memory 227. The control panel 214 is coupled to the central processor 221. The central processor 221 is coupled to the display 216. The ball impact detection circuit 225 is coupled to the ball impact detection conditioning circuit 226. The ball impact detection conditioning circuit 226 is coupled to the central processor 221. The wireless transceiver 218 is coupled to the central processor 221. The ultrasonic transmitters 212 and the ultrasonic transmitter/receiver 213 are coupled to the central processor 221.

When the catcher wears the wrist accuracy unit and speedgun 210 on his wrist adjacent to his mitt the display 216 faces him while the ultrasonic transmitters 212 and the ultrasonic transmitter/receiver 213 face the incoming baseball. The catcher operates the wrist accuracy unit and speedgun 210.

Before presenting a target to the pitcher he activates the wrist accuracy unit and speedgun 210 by means of buttons 220 on the control panel 214 in order to measure and record the position of the pitching target, namely his mitt. The location of the wrist accuracy unit and speedgun 210 is measured by the transmission of consecutive signals from the ultrasonic transmitters 212. Concurrent with each of these signals a radio pulse is sent by the wireless transceiver 218. The combination of the locating array 11 which is positioned several feet in front of the catcher on the ground in a measured and known location and the processor 12 uses the radio pulse and signals from the ultrasonic transmitters 212 to determine the three-dimensional position of the wrist accuracy unit and speedgun 210 and hence the position of the pitching target, namely the catcher's mitt. When two ultrasonic transmitters 212 are used in order to allow measurement of both location and rotation of the wrist, a more accurate determination of the position of the mitt's pocket, which is the precise target and in which the pitched baseball lands, is able to be determined. After the pitcher pitches the baseball the ultrasonic transmitter/receiver 213 determines the speed of the pitched baseball as it approaches the mitt. The central processor 221 controls the ultrasonic transmitters 212 and the ultrasonic transmitter/receiver 213 and extrapolates the time of impact. At the time of ball impact the ultrasonic transmitters 212 send another set of radio-frequency and ultrasonic signals to the locating array 11. The processor 12 calculates the after catch position of the mitt and transmits this information to the wrist accuracy unit and speedgun 210. This information along with the speed of the pitched baseball is displayed by the central processor 221 to the catcher on the display 216. The ball impact detection circuit 225 includes either an accelerometer or a microphone for detecting either mechanical movement or sound which the arriving pitched baseball produces. The ball impact detection circuit 225 alternately or supplementally can be used to determine the time of the arrival of the pitched baseball. The ball impact conditioning circuit 226 conditions this signal and communicates it the central processor 221.

The ball impact detection circuit 225 may include three accelerometers which may also be used as an alternative means to determine the movement of the mitt from the time the target is presented to when the pitched baseball arrives by integrating the three-dimensional acceleration signals within the central processor 221. To facilitate this accelorometric movement detection scheme the ball impact conditioning circuit 226 should include an analog to digital converter.

The ultrasonic transmitter/receiver 213 operates to measure velocity of the pitched baseball by one of two methods. The first method is to measure distance to the baseball with respect to time. Each distance measurment is made by measuring the time delay between the time of transmission of a signal and reception of the echo returning from the pitched baseball. The second method is to evaluate the Doppler frequency shift of the echo with respect to the transmitted signal.

Figure 10:
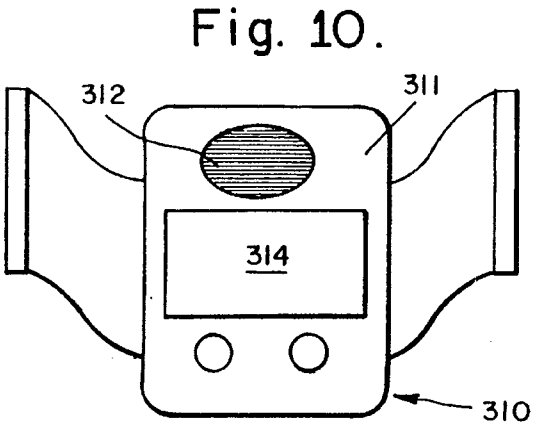
FIG. 10 is a front elevational view of a wrist speedgun and accuracy unit with a detachable transducer unit according to the second embodiment.
Figure 12:
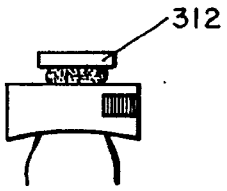
FIG. 12 is top plan view of the detachable transducer unit of the wrist speedgun and accuracy unit of FIG. 10.
Figure 11:
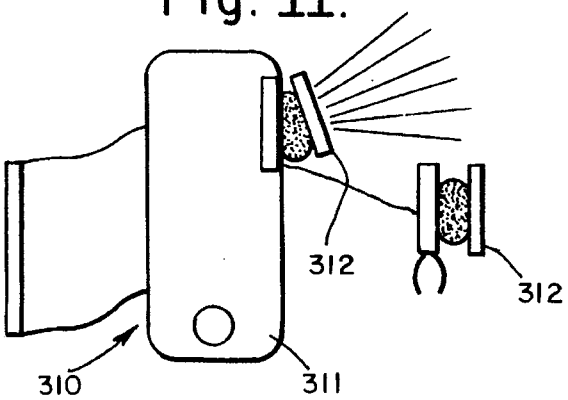
FIG. 11 is a side elevational view of the wrist speedgun and accuracy unit of FIG. 10.

Referring to FIG. 10 in conjunction with FIG. 9, FIG. 11 and FIG. 12 a wrist speedgun and accuracy unit 310 includes a housing 311, an ultrasonic transmitter/receiver unit 312, a housing 313, a processor 221 and a display 314. The housing 311 may be strapped to the wrist. The functional block diagram of the wrist speedgun and automatic target unit 310 is the same as the functional block diagram of the wrist accuracy unit and speedgun 210 in FIG. 9. The housing 311 may be strapped to the wrist. The measurement of both the baseball velocity and the mitt position for use in making the accuracy measurement is accomplished with the ultrasonic transmitter/receiver unit 312. The wrist speedgun and automatic target unit 310 is used by removing the ultrasonic transmitter/receiver unit 312 therefrom and clipping it to the catcher's mitt. The ultrasonic transmitter/receiver unit 312 is mounted on a ball and socket joint 315 so that it can be adjusted to point in the direction of the incoming pitched baseball.

The two functions of the ultrasonic transmitter/receiver unit 312 are 1) the measurement of the velocity of the pitched baseball as it approaches the catcher's mitt; and 2) the transmission of an ultrasonic signal before and after the pitch which allows the determination of pitch accuracy. The second wrist speedgun and automatic target unit 310 performs both of these functions in the same manner as the wrist speedgun and automatic target unit 210. Because the ultrasonic transducer is positioned on the catcher's mitt directly a single transducer is adequate to provide both the measurement of the baseball velocity and the determination of the mitt location.

Figure 14:
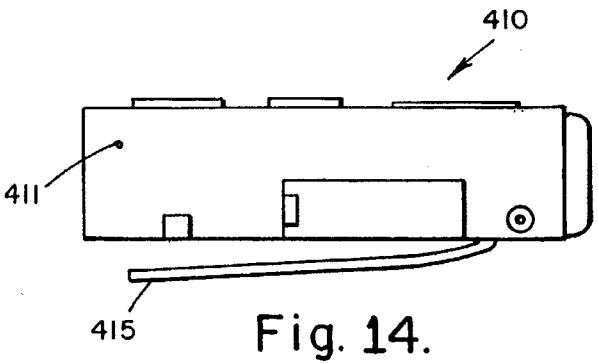
FIG. 14 is a side elevational view of the hand-held speedgun of FIG. 13.
Figure 13:
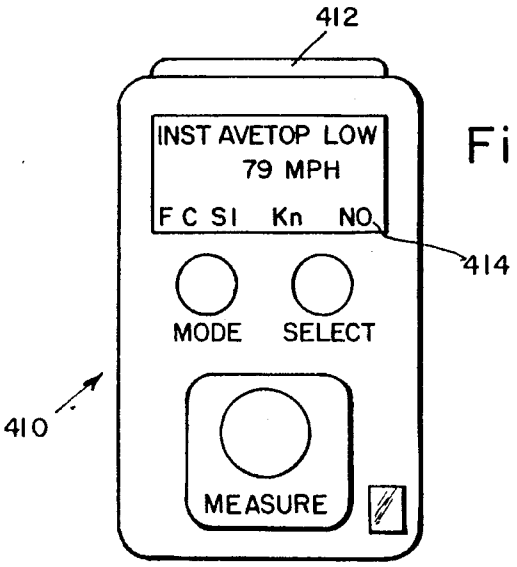
FIG. 13 is a front elevational view of a hand-held speedgun according to the third embodiment.

Referring to FIG. 13 in conjunction with FIG. 9 and FIG. 14 a hand-held speed gun 410 includes a housing 411, an ultrasonic transmitter/receiver unit 412, a display 414 and a belt-clip 415. The hand-held speed gun 410 also includes processing electronics and a wireless transmitter/receiver and operates in the similar manner as the wrist speedgun and automatic target unit 210 operates by measuring the distance with respect to time or alternatively by measuring the Doppler shift of the echo. The hand-held speed gun 410 is small enough to be able to fit in a shirt pocket.

Figure 15:
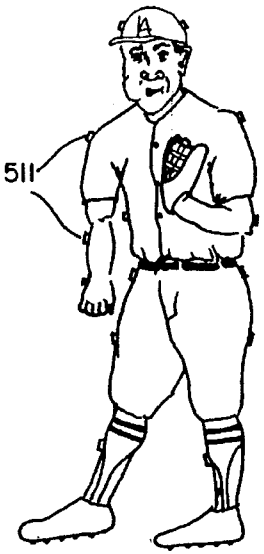
FIG. 15 is a schematic diagram of a pitcher who has a plurality of transmitters which are applied to various parts of his body according to the fourth embodiment.

Referring to FIG. 15 in conjunction with FIG. 1, FIG. 2, FIG. 4 and FIG. 5 the system 10 is also used to measure the motions of the pitcher's body as he delivers a baseball pitch in order to determine and analyze the pitching mechanics of the pitcher. The system 10 further includes a plurality of ultrasonic transmitters 511 and a plurality of locating arrays 512 which are disposed around the pitcher. The ultrasonic transmitters 511 are disposed on the body of the pitcher and are placed at various critical poistion of his body, generally at his hands, his elbow joints, his shoulder joints, his ankle joints, his knee joint and both sides of his head. Each locating array 512 includes at least three non-collinear ultrasonic receivers and is similar to the locating array 11. The locating arrays 512 are disposed around the pitcher in measured and known positions and operates in the same manner as the locating arrays 11. The processor 12 is coupled to the ultrasonic transmitters 511 and the ultrasonic receivers of the locating arrays 512. The display 13 is coupled to the processor 12. The signals from the ultrasonic transmitters 511 may be multiplexed in either time or frequency.

At the start of a training session the ultrasonic transmitters 511 are coupled to the processor 12 and programmed thereby. Each ultrasonic transmitter 511 is identified and placed at a certain body position and programmed with timing and/or frequency information. This information is the time at which the individual ultrasonic transmitter 511 will send its signal and/or the frequency at which it will transmit. During the pitching session the locating arrays 512 receive a sequence of signals from the ultrasonic transmitters 511 which are located on the body of the pitcher. The transmitters 511 may either fire in sequence being identified according to their assigned order within that sequence or fire together being identified according to their assigned frequency. Based on these signals the processor 12 calculates the three-dimensional position of each signal and accordingly the position of that body point over time. This information is processed and presented to the user of the system 10 as either data or graphics, for example a representational picture of the pitcher's body. The ultrasonic transmitters 511 may be either augmented with or replaced by either a plurality of three-dimensional accelerometers or a plurality of optical transmitters. The locating arrays would then include a plurality of optical receivers configured as additional position detectors 11.

Figure 17:
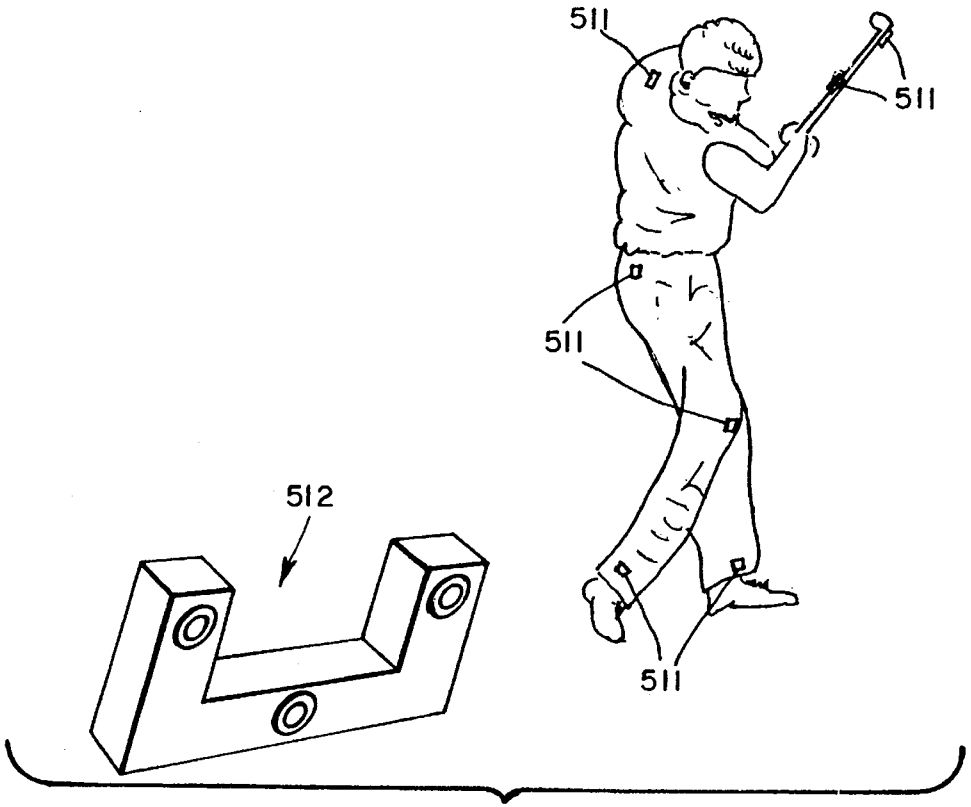
FIG. 17 is a schematic diagram of a golfer who has a plurality of transmitters which are applied to various parts of his body and his bat according to the sixth embodiment.
Figure 16:
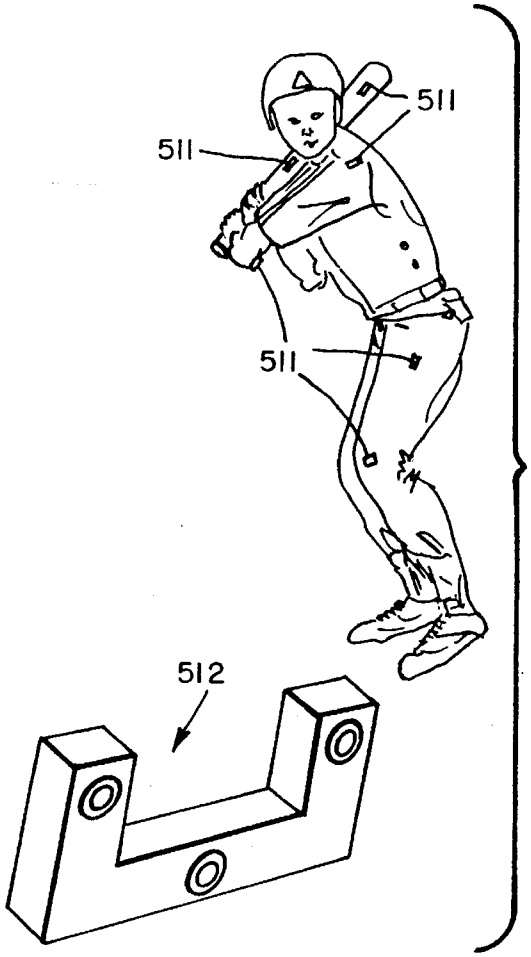
FIG. 16 is a schematic diagram of a batter who has a plurality of transmitters which are applied to various parts of his body and his bat according to the fifth embodiment.

Referring to FIG. 16 in conjunction with FIG. 15 and FIG. 17 the system 10 may be used to measure the motions of the body of either a batter or a golfer as he swings either a bat or a club in order to determine and analyze the his body mechanics.

The system 10 includes a plurality of transmitters disposed on the body of the subject and at least one determinator of positions of the transmitters adjacent to the subject. When the transmitters are optical the determinator of positions includes at least one two dimensional array of optical sensors. When the transmitters are ultrasonic the determinator of positions includes at least three non-collinear ultrasonic receivers. The system 10 may also be used for determining and analyzing body mechanics of a subject undergoing either a medical diagnosis or rehabilitation.

From the foregoing it can be seen that a system for training a pitcher to pitch a baseball has been described. It should be noted that the sketches are not drawn to scale and that distance of and between the figures are not to be considered significant. Accordingly it is intended that the foregoing disclosure and showing made in the drawing shall be considered only as an illustration of the principle of the present invention.

What is claimed is:

1. A system for training a pitcher to pitch a baseball, said system comprising:

a. a mitt worn by a catcher, said mitt being a movable target to which a pitcher pitches a baseball;

b. a movement detector coupled to said mitt whereby said movement detector measures the distance which a said mitt is moved from its initial target position to a position required to catch a pitched baseball;

c. a processor coupled to said movement detector for calculating the accuracy of a pitched baseball as determined by said distance said mitt is moved from said initial target position to said position required to catch a pitched baseball; and d. a display coupled to said processor for visually displaying information as to the accuracy of a pitch as determined by said processor.

2. A system for training a pitcher to pitch a baseball according to claim 1 wherein said movement detector is at least one accelerometer.

3. A system for training a pitcher to pitch a baseball, said system comprising:

a. a mitt worn by a catcher, said mitt being a target whose position is set by a catcher and to which position a pitcher attempts to pitch a baseball;

b. a target-set indicator connected to said mitt for allowing a catcher to denote a location at which said catcher has said mitt positioned as said target;

c. a ball-arrival detector coupled to said mitt where arrival of the pitched baseball in said mitt is detected as the catcher catches the pitched baseball;

d. a position determinator coupled to said mitt, to said target-set indicator, and to said said ball-arrival detector whereby said position determinator measures the position of said mitt both at times when a catcher denotes said setting of target by means of said target set indicator and when the catcher catches the pitched baseball as detected by said ball-arrival detector;

e. an accuracy-calculator coupled to said target-set indicator, said ball-arrival detector and said position determinator, whereby said accuracy-calculator calculates the accuracy of the pitched baseball as determined by the difference between the position of the mitt at said time of target indication and at said time of ball arrival detection by said ball arrival detector; and f. a display coupled to said accuracy-calculator which provides users with visual information concerning measured accuracy of a pitched baseball.

4. A system for training a pitcher to pitch a baseball according to claim 3, wherein said position determinator includes:

a. at least one ultrasonic transmitter coupled to said mitt;

b. at least three non-collinear ultrasonic receivers disposed in fixed positions away from said ultrasonic transmitter for measuring the distance between each of said ultrasonic receivers and said ultrasonic transmitter;

c. a signal-generation circuit coupled to said ultrasonic transmitter where said signal-generation circuit causes the emission of ultrasonic signals from said ultrasonic transmitter through excitation of said ultrasonic transmitter by applying electrical signals to said ultrasonic transmitter;

d. a signal-detection circuit coupled to each of said ultrasonic receivers whereby said said signal-detection circuit converts low-level ultrasonic signal-induced analog electrical signals from said receiver into digital signal for recognition by a digital processor;

e. a position-determination processor coupled to said target-set indicator, said ball-arrival detector, said signal-detection circuit and said signal-generation circuit where said position-determination processor serves to initiate and control said measurement of positions of said ultrasonic transmitter and hence of said mitt at points in time defined by and in response to signals from said target-set indicator and said ball-arrival detector.

5. A system for training a pitcher to pitch a baseball according to claim 3, wherein said position determinator includes at least one accelerometer.

6. A system for training a pitcher to pitch a baseball according to claim 3, wherein said position determinator includes at least one accelerometer.

* * * * *